US006943659B2

(12) United States Patent
Kitsui et al.

(10) Patent No.: US 6,943,659 B2
(45) Date of Patent: Sep. 13, 2005

(54) COATED VARISTOR

(75) Inventors: Tsutomu Kitsui, Eniwa (JP); Minoru Ouchi, Eniwa (JP); Naoki Muto, Chitose (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/506,054

(22) PCT Filed: Jun. 24, 2003

(86) PCT No.: PCT/JP03/07979

§ 371 (c)(1),
(2), (4) Date: Aug. 27, 2004

(87) PCT Pub. No.: WO2004/023500

PCT Pub. Date: Mar. 18, 2004

(65) Prior Publication Data

US 2005/0088273 A1 Apr. 28, 2005

(30) Foreign Application Priority Data

Aug. 29, 2002 (JP) ..... 2002-250906

(51) Int. Cl.[7] ..... H01C 7/13
(52) U.S. Cl. ..... 338/20; 338/21
(58) Field of Search ..... 338/20, 21

(56) References Cited

U.S. PATENT DOCUMENTS 4,278,961 A * 7/1981 Schroeder et al. ..... 338/21
4,933,659 A * 6/1990 Imai et al. ..... 338/20
5,192,834 A * 3/1993 Yamanishi et al. ... 174/120 SR
6,541,066 B1 * 4/2003 Geus ..... 427/226
2001/0003358 A1 * 6/2001 Terase et al. ..... 252/62

FOREIGN PATENT DOCUMENTS

| | | | |
|---|---|---|---|
| JP | 55-46513 | A | 4/1980 |
| JP | 63-47901 | A | 2/1988 |
| JP | 63-273310 | A | 11/1988 |
| JP | 07-057963 | A | 3/1995 |
| JP | 2002-159826 | A | 6/2002 |

OTHER PUBLICATIONS

English Translation for JP 63–47901, Yodgawa Feb. 1988.*

International Search Report for PCT/JP2003/007979, dated Oct. 7, 2003.

* cited by examiner

*Primary Examiner*—Karl D. Easthom
(74) *Attorney, Agent, or Firm*—RatnerPrestia

(57) ABSTRACT

A varistor includes a varistor element, a first layer which is porous on the varistor element, and a second layer on th first coating. The thickness t (mm) of the second layer is not smaller than 1.3/V. where V(ml/g) is the volume of pores of the first layer exposed to an outside of the first layer. This varistor includes the outer layers protected from being broken even when a non-ohmic interface in a voltage non-linear resistor is broken down with a voltage exceeding a rated level.

6 Claims, 3 Drawing Sheets

COATED VARISTOR

This Application is a U.S. National Phase Application of PCT International Application PCT/JP2003/007979.

TECHNICAL FIELD

The present invention relates to an encapsulated varistor.

BACKGROUND ART

Varistors have non-linear resistance properties in which resistances thereof rapidly decline when voltages input thereto exceed predetermined levels and are widely used as electronic components for suppressing surge voltages generated commonly in electronic devices. An encapsulated varistor including a varistor element encapsulated in an external package made of epoxy resin or the like is used in order to increase insulation and protection from mechanical impacts, heat, moisture, chemicals, and others.

FIG. 6 is a cross sectional view of a conventional encapsulated varistor. The varistor includes a varistor element and an external coating of epoxy resin which encloses the varistor element. A voltage-non-linear resistor 21 is fabricated by, for example, molding and sintering to have a disk shape of a powder mixture which comprises ZnO, $Bi_2O_3$, and others. Electrodes 22 are formed by baking on both sides of the non-linear resistor 21. The electrodes 22 is connected by solder 24 to lead terminals 23, thus providing the varistor element. The non-linear resistor 21, the electrodes 22, the solder 24, and portions of lead terminals 23 are encapsulated in an external coating 25 of epoxy resin.

When the encapsulated varistor is loaded with a voltage exceeding its rated level, the voltage-non-linear resistor is broken down at a non-ohmic interface having a low resistant region remain unchanged, thus having its overall resistance decrease. When the encapsulated varistor is connected in series to a protective fuse for protection of a circuit, the decreasing resistance allows a large electric current to flow continuously across it, hence heating up the broken non-ohmic interface of the voltage-non-linear resistor within a short period of time before the fuse is melt down. Accordingly, since the voltage-non-linear resistor, the electrodes, lead wires, and the external coating of epoxy resin are heated up, fused, and decomposed, they produce a considerable volume of gaseous substance. The gaseous substance breaks the external coating and permit melting fragments to leak.

SUMMARY OF THE INVENTION

A varistor includes a varistor element, a first layer which is porous on the varistor element, and a second layer on the first coating. The thickness t (mm) of the second layer is not smaller than 1.3/V, where V(ml/g) is the volume of pores of the first layer exposed to an outside of the first layer.

This varistor includes the outer layers protected from being broken even when a non-ohmic interface in a voltage non-linear resistor is broken down with a voltage exceeding a rated level.

DESCRIPTION OF THE PREFERRED EMBODIMENTS

Exemplary Embodiment 1

Figure 1:
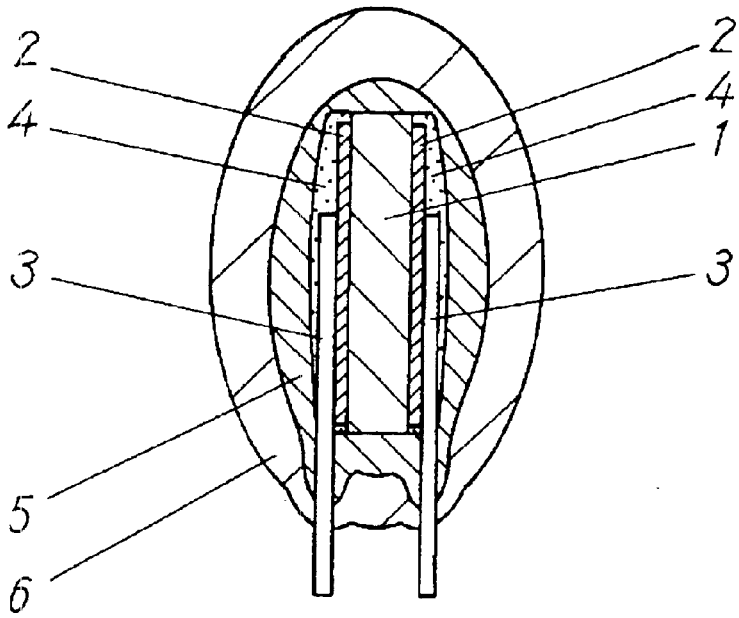
FIG. 1 is a cross sectional view of an encapsulated varistor according to Exemplary Embodiment 1 of the present invention.
Figure 2:
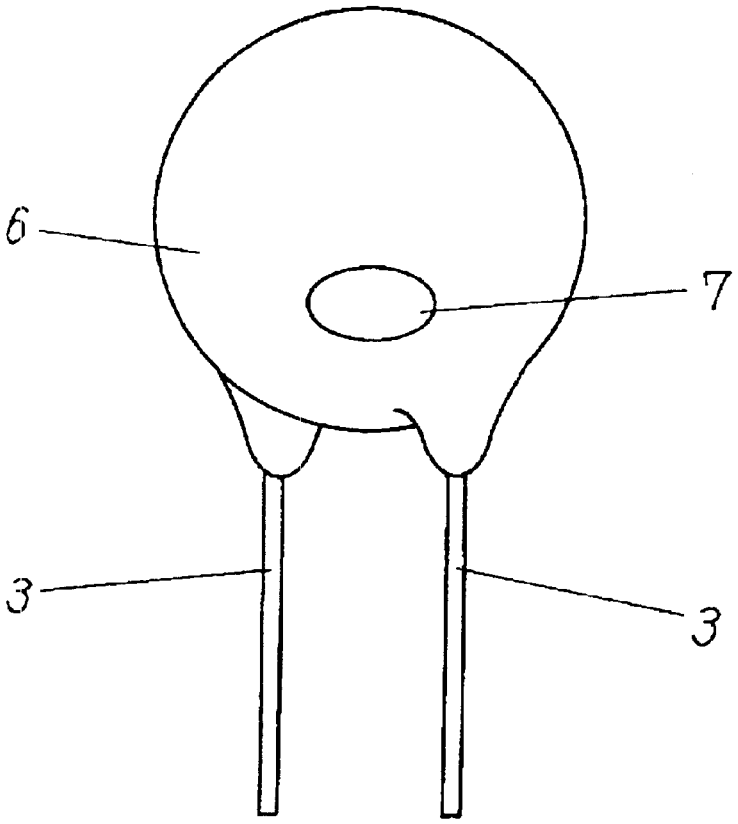
FIG. 2 is a perspective view of the encapsulated varistor of Embodiment 1.

FIG. 1 is a cross sectional view of an encapsulated varistor according to Exemplary Embodiment 1 of the present invention. FIG. 2 is a perspective view of the encapsulated varistor of Embodiment 1. The varistor includes a voltage-non-linear resistor 1, electrodes 2, lead terminals 3, solder 4, a first outer layer 5, a second outer layer 6, and a printed film 7 of heat-sensitive ink.

As shown in FIG. 1, the encapsulated varistor of Embodiment 1 includes a varistor element including the voltage-non-linear resistor 1, the electrodes 2 on both sides of the voltage-non-linear resistor 1, and the lead terminals 3 connected by strips of the solder 4 to the electrodes 2. The voltage-non-linear resistor 1, the electrodes 2, the solder 4, and portions of the lead terminals 3 are covered with the first outer layer 5 made of porous material. The first outer layer 5 is covered with the second outer layer 6. The second outer layer 6 has the printed film 7 provided on the outer surface thereof.

A method of manufacturing the encapsulated varistor of Embodiment 1 will be described.

Powder essentially including zinc and additive, such as magnesium oxide, bismuth oxide, and cobalt oxide, is formed and sintered at 1200° C. to have a disk shape, thus providing the voltage-non-linear resistor 1. The non-linear resistor 1 has both sides coated with silver-based paste and have the paste baked to provide the electrodes 2. The electrodes 2 are connected to lead terminals 3 of soft copper wire with solder 4, thus providing the varistor element.

The voltage-non-linear resistor 1, the electrodes 2, the solder 4, and portions of the lead terminals 3 of the varistor element are protected with the first outer layer 5 made of porous epoxy resin material including foamable agent. The first outer layer 5 is then covered with the second outer layer 6 of epoxy resin material. A pattern of heat sensitive ink as heat sensitive material is printed on the outer surface of the second outer layer 6 to provide a printed film 7, thus providing the encapsulated varistor of Embodiment 1.

The first outer layer 5, the second outer layer 6, and the printed film 7 will be described in more detail.

A powder form of epoxy resin was sufficiently mixed at different ratios with thermally-expandable-micro-capsules made by encapsulating low boiling hydrocarbon in copolymer capsules, such as vinylidene chloride or acryl nitryl, hence preparing different types of foamable micro-capsule having epoxy resin powder.

The varistor element was preheated to 170° C. in a dryer, and a portion of the varistor element including the voltage-non-linear resistor 1, the electrodes 2, the solder 4, and portions of the lead terminals 3 was buried in each type of the micro-capsule-added epoxy resin powder. The micro-capsule-added epoxy resin powder was heated with the preheating energy to melt, a micro-capsule-added epoxy resin was attached to a surface of the portion of the varistor element. The varistor element covered with the micro-capsule-added epoxy resin was heated again at 170° C. in the dryer. Then, the micro-capsules added epoxy resin was foamed and cured to become a first outer layer 5 which was porous and covers the varistor element.

Table 1 illustrates resultant measurements of the volume and the diameter of air bubbles or exposed pores in the first porous outer layer 5 in relation to amounts of the thermal-expandable micro-capsules-added epoxy resin powder. The volume of the exposed pores was measured with a porosimeter by a mercury filling method. The diameter of the exposed pores was measured with a scanning electron microscope observing cross sections of test pieces. As shown in Table 1, the volume and diameter of the exposed pores in the first layer varies depending on amounts of the thermally-expandable micro-capsules.

TABLE 1

| Sample No. of Resin | Amount of Added Micro-Capsule (wt. %) | First Outer Layer Volume of Exposed Pore (ml/g) | First Outer Layer Diameter of Exposed Pore (μm) |
|---|---|---|---|
| A | 0.5 | 0.513 | 5–50 |
| B | 1.0 | 0.827 | 5–60 |
| C | 3.0 | 1.358 | 10–120 |
| D | 5.0 | 1.783 | 20–200 |

Then, by a fluid immersion method similar to the method for making the first outer layer 5, the second outer layer 6 covering the first outer layer 5 is formed to provide epoxy resin powder having a low fusing temperature ranging from 41° C. to 43° C. (by a DSC measuring method). Some samples of the varistor having various thicknesses of second outer layers 6. The thickness of the second outer layer 6 was changed by modifying durations for immersing of the varistor element in a coating fluid tub and the number of coating actions.

Then, by a transfer printing method, irreversible heat sensitive ink was tinted at substantially 160° C. for providing the pattern of printed film 7 on s surface of the second outer layer 6, thus preparing samples of the encapsulated varistor of Embodiment 1.

The samples of the encapsulated varistor of Embodiment 1 were then examined for the protection against breakage of a non-ohmic interface of the voltage-non-linear resistor by an overloaded input to the varistor. The samples of the varistor element had outer diameters of 9.5 mm, and had the voltage-non-linear resistor 1 having varistor voltages of 270V.

Figure 3:
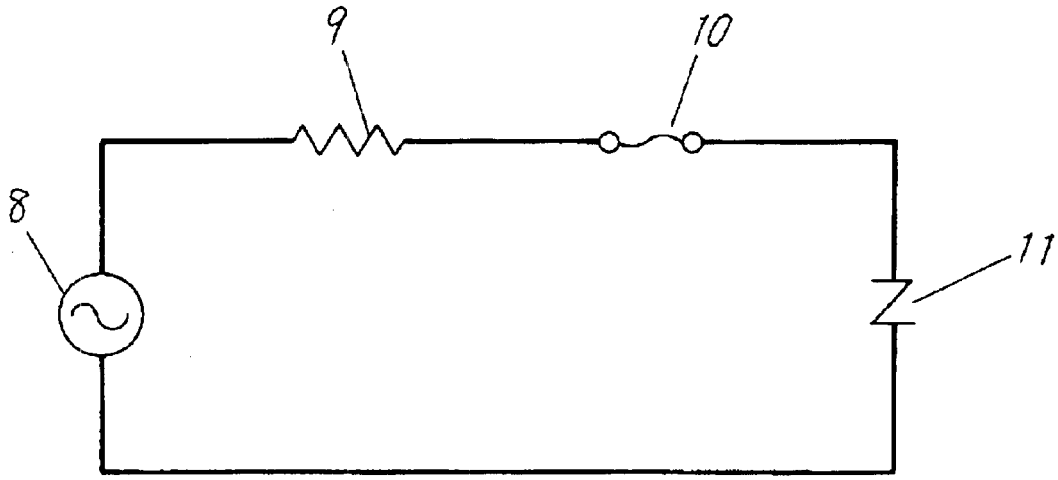
FIG. 3 illustrates a circuit for evaluating the varistor of Embodiment 1.

FIG. 3 illustrates a circuit for evaluating the samples the varistors 11. The circuit includes an alternating-current source 8, a circuit impedance 9, and a protective fuse 10. The circuit impedance 9 was determined to be 5Ω, which is commonly used in any source circuit. The protective fuse 10 was determined to be 7A, which meets a suggested current of the voltage-non-linear resistor 1. An alternating-current voltage at loading rate of 100%, which is equal to the varistor voltage was applied for about 0.5 second until the protective fuse 10 was fused down. Then, the non-ohmic interface of the voltage non-linear resistor 1 was broken down, hence terminating an operation of the varistor.

Figure 4:
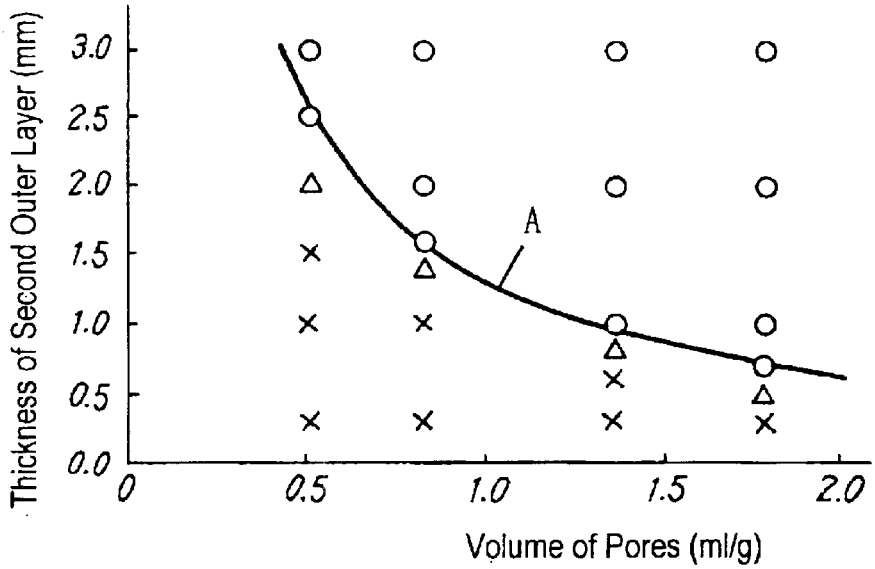
FIG. 4 illustrates an evaluation result of the varistor of Embodiment 1.

Resultant measurements of protection against breakage in relation to the volume and diameter of the exposed pores in the fist outer layer 5 and the thickness of the second outer layer 6 are shown in Table 2. FIG. 4 illustrates a evaluation result of protection property against breakage in which a horizontal axis represents the volume of exposed pores in the first outer layer 5, while a vertical axis represents the thickness of the second outer layer 6. In FIG. 4, a symbol "○" indicates the number of broken varistors of 0/30, a symbol "X" indicates the number of broken varistors of 30/30, and a symbol "Δ" indicates the number of broken varistors other than 0/30 and 30/30.

TABLE 2

| Sample No. of Varistor | First Outer Layer Volume of Exposed Pores (ml/g) | First Outer Layer Diameter of Exposed Pores (μm) | Thickness of Second Outer Layer (mm) | (Number of Broken Samples)/(Number of Samples) |
|---|---|---|---|---|
| 1(*) | 0.513 | 5–50 | 0.3 | 30/30 |
| 2(*) | 0.513 | 5–50 | 1.0 | 30/30 |
| 3(*) | 0.513 | 5–50 | 1.5 | 30/30 |
| 4(*) | 0.513 | 5–50 | 2.0 | 17/30 |
| 5(*) | 0.513 | 5–50 | 2.5 | 0/30 |
| 6 | 0.513 | 5–50 | 3.0 | 0/30 |
| 7(*) | 0.827 | 5–60 | 0.3 | 30/30 |
| 8(*) | 0.827 | 5–60 | 1.0 | 30/30 |
| 9(*) | 0.827 | 5–60 | 1.4 | 11/30 |
| 10 | 0.827 | 5–60 | 1.6 | 0/30 |
| 11 | 0.827 | 5–60 | 2.0 | 0/30 |
| 12 | 0.827 | 5–60 | 3.0 | 0/30 |
| 13(*) | 1.358 | 10–120 | 0.3 | 30/30 |
| 14(*) | 1.358 | 10–120 | 0.6 | 30/30 |
| 15(*) | 1.358 | 10–120 | 0.8 | 7/30 |
| 16 | 1.358 | 10–120 | 1.0 | 0/30 |
| 17 | 1.358 | 10–120 | 2.0 | 0/30 |
| 18 | 1.358 | 10–120 | 3.0 | 0/30 |
| 19(*) | 1.783 | 20–200 | 0.3 | 30/30 |
| 20(*) | 1.783 | 20–200 | 0.5 | 3/30 |
| 21(*) | 1.783 | 20–200 | 0.7 | 0/30 |
| 22 | 1.783 | 20–200 | 1.0 | 0/30 |
| 23 | 1.783 | 20–200 | 2.0 | 0/30 |
| 24 | 1.783 | 20–200 | 3.0 | 0/30 |

As shown in Table 2 and FIG. 4, the protection property against breakage significantly depends on the volume of exposed pores in the first outer layer and the thickness of the second outer layer 6. As shown in FIG. 4, varistors have preferable protection property against breakage of the outer layers when the thickness t(mm) of the second outer layer 6 is 1.3/V, where V(ml/g) is the volume of the exposed pores in the first outer layer 5 (denoted by curve A in FIG. 4). Even if the non-ohmic interface of the voltage-non-linear resistor is broken down, the first outer layer absorbs the fused fragments and gaseous substances generated by heat, hence reducing an increase of an internal pressure in the resin. Then, the second outer having a strength more than a predetermined level traps the melting fragments and gaseous substances therein, hence preventing the varistors from breakage of the outer layers and scattering of the melting fragments. The samples accompanied by "(★)" did not have preferable characteristics.

The first outer layer 5 according to Embodiment 1 made by foaming and curing the epoxy resin powder added with thermally-expandable micro-capsules has preferably the volume of the exposed pores ranging from 0.5 ml/g to 2.0 ml/g. The volume of the exposed pores in the first outer layer 5 smaller than 0.5 ml/g requires the thickness of the second outer layer 6 greater than 2.5 mm and substantially 3 mm for ensuring stability in its manufacturing process. This thickness increases the number of processes for forming the second outer layer 6 and hence increase the overall production cost as well as the overall dimensions of the varistor. The volume of the exposed pores exceeding 2.0 ml/g, in which the micro-capsules are added into the epoxy resin excessively, reduces a bonding strength between the voltage-non-linear resistor 1 and the first outer layer 5, thus producing a successive gap at the interface of them, hence having electrical insulating properties of the varistor decline.

Thus, the volume of the exposed pores in the first outer layer 5 formed by foaming and curing the epoxy resin powder added with the thermally-expandable microcapsules is preferably adjusted within a range from 0.5 ml/g to 2.0 ml/g. The thickness t(mm) equal to or more than of 1.3/V, where V(ml/g) is the volume of the exposed pores in the first outer layer 5, provides a preferable protection property against breakage. Even when the non-ohmic interface in the voltage-non-linear resistor is broken down, the encapsulated varistor has the outer layers not broken, hence providing the varistor with preferable electrical characteristics at a lower cost.

Some of the samples of the encapsulated varistor of Embodiment 1 evaluated in the protection property against breakage includes broken non-ohmic interfaces in their voltage-non-linear resistors which lose their varistor characteristics even with their outer layers remaining. These samples including the voltage non-linear resistors 1 of the varistor elements are visibly noticed by the printed film 7 having an appearance, such as a color changed from blue to gray with heat. Thus, the printed film 7 provided with the heat sensitive ink on a surface of the second outer layer 6 having the color change indicates a fault occurs in the voltage non-linear resistor 1.

Exemplary Embodiment 2

An encapsulated varistor according to Exemplary Embodiment 2 of the invention has a structure substantially identical to a varistor of Embodiment 1 shown in FIG. 1. The encapsulated varistor of Embodiment 2, differently from that of Embodiment 1, includes a first outer layer 5 made of an epoxy resin powder added with heat decomposable chemical foaming agent. The first outer layer 5 of Embodiment 2 will be described in more detail.

Epoxy resin material was mixed and kneaded with curing agent, filler, and the heat decomposable foaming agent of azoic compound, hence preparing epoxy resin powder with the heat decomposable chemical foaming agent of Embodiment 2. Various types of epoxy resin powder with the heat decomposable chemical foaming agent were prepared by varying an amount of the heat decomposable foaming agent.

Then, a varistor element including a voltage-non-linear resistor 1, electrodes 2, solder 4, and lead terminals 3 was pre-heated at 170° C. in a dryer. The varistor element including the voltage-non-linear resistor 1, the electrodes 2, the solder 4, and the portions of the lead terminals 3 was buried in each type of the epoxy resin powder with the heat decomposable chemical foaming agent. According to melting of the epoxy resin powder with the heat decomposable chemical foaming agent, epoxy resin is bonded on a surface of the varistor element. The varistor element covered with epoxy resin with the heat decomposable chemical foaming agent is heated again at 170° C. in the dryer. Then, the epoxy resin with the heat decomposable chemical foaming agent is foamed and cured, hence providing a first outer layer 5 on the varistor element.

During the curing of the epoxy resin with the heat decomposable chemical foaming agent, the heat decomposable chemical foaming agent is decomposed to generate gaseous substances, thus generating a number of air bubbles while the epoxy resin powder melts at a curing temperature. In this condition, the epoxy resin reacts with the cursing agent, hence providing the first outer layer 5 with a number of exposed pores therein.

Table 3 illustrates resultant measurements of the volume and the diameter of the exposed pores in the first porous outer layer 5 in relation to an amount of the heat decomposable chemical foaming agent added to the epoxy resin powder. The volume and diameter of the exposed pores were measured by a method identical to that of Embodiment 1. As shown in Table 3, the volume and diameter of the exposed pores in the first layer varies depending on the amount of the heat decomposable chemical foaming agent.

TABLE 3

| | | First Outer Layer | |
|---|---|---|---|
| Sample No. of Resin | Amount of Added Foaming Agent (wt. %) | Volume of Exposed Pores (ml/g) | Diameter of Exposed Pore (μm) |
| E | 1.0 | 0.521 | 30–150 |
| F | 2.0 | 1.465 | 40–250 |
| G | 2.5 | 1.944 | 50–280 |
| H | 3.0 | 2.437 | 50–330 |

Then, the first outer layer 5 was covered with a second outer layer 6 made of epoxy resin powder having a low melting temperature by a method similar to that of Embodiment 1. Samples of the encapsulated varistor were manufactured having various thicknesses of the second outer layers 6. Each of the samples of the encapsulated varistor of Embodiment 2 was finally provided with a printed film 7 of heat sensitive ink on the second outer layer 6.

The encapsulated varistor of Embodiment 2 was then evaluated in protection property against breakage when their non-ohmic interface of their voltage non-linear resistor were broken. The samples of the varistor elements had an outer diameter of 9.5 mm, and the voltage non-linear resistor 1 has a varistor voltage of 270V. A test circuit and test conditions for evaluating them were the same as that of Embodiment 1.

Figure 5:
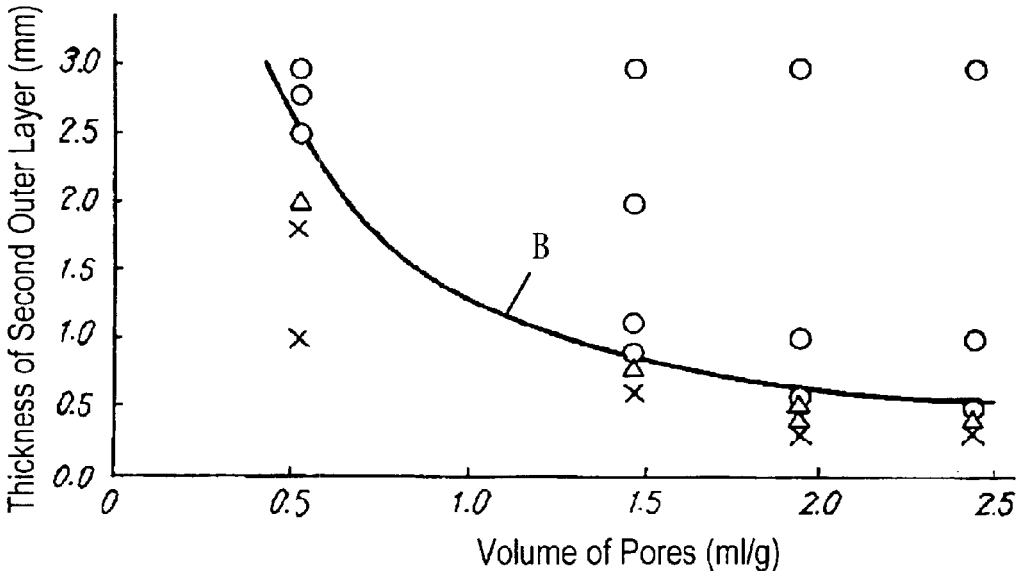
FIG. 5 illustrates an evaluation result of a varistor according to Exemplary Embodiment 2 of the invention.
Figure 6:
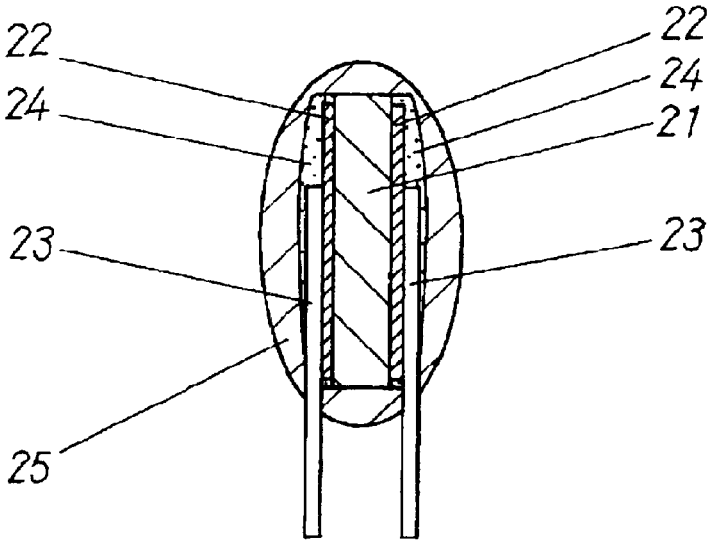
FIG. 6 is a cross sectional view of a conventional encapsulated varistor.

Resultant measurements of the protection property against breakage of the encapsulated varistor of Embodiment 2 in relation to the volume and diameters of exposed pores in the fist outer layer 5 and to the thickness of the second outer layer 6 are shown in Table 4. FIG. 5 illustrates a evaluation result of the protection property against breakage in which a horizontal axis represents the volume of exposed pores in the first outer layer 5, while a vertical axis represents the thickness of the second outer layer 6. In FIG. 5, a symbol "°" indicates the number of broken varistors of 0/30, a symbol "X" indicates the number of broken varistors of 30/30, and a symbol "Δ" indicates the number of broken varistors other than 0/30 and 30/30.

TABLE 4

| | First Outer Layer | | | (Number |
|---|---|---|---|---|
| Sample No. of Varistor | Volume of Exposed Pores (ml/g) | Diameter of Exposed Pores (μm) | Thickness of Second Outer Layer (mm) | of Broken Samples)/ (Number of Samples) |
| 31(*) | 0.521 | 30–80 | 1.0 | 30/30 |
| 33(*) | 0.521 | 30–80 | 1.8 | 30/30 |
| 33(*) | 0.521 | 30–80 | 2.0 | 24/30 |
| 34 | 0.521 | 30–80 | 2.5 | 0/30 |
| 35 | 0.521 | 30–80 | 2.8 | 0/30 |
| 36 | 0.521 | 30–80 | 3.0 | 0/30 |
| 37(*) | 1.465 | 50–300 | 0.6 | 30/30 |

TABLE 4-continued

| Sample No. of Varistor | First Outer Layer: Volume of Exposed Pores (ml/g) | First Outer Layer: Diameter of Exposed Pores (μm) | Thickness of Second Outer Layer (mm) | (Number of Broken Samples)/(Number of Samples) |
|---|---|---|---|---|
| 38(*) | 1.465 | 50–300 | 0.8 | 4/30 |
| 39 | 1.465 | 50–300 | 0.9 | 0/30 |
| 40 | 1.465 | 50–300 | 1.1 | 0/30 |
| 41 | 1.465 | 50–300 | 2.0 | 0/30 |
| 42 | 1.465 | 50–300 | 3.0 | 0/30 |
| 43(*) | 1.944 | 50–280 | 0.3 | 30/30 |
| 44(*) | 1.944 | 50–280 | 0.4 | 28/30 |
| 45(*) | 1.944 | 50–280 | 0.5 | 2/30 |
| 46(*) | 1.944 | 50–280 | 0.6 | 0/30 |
| 47 | 1.944 | 50–280 | 1.0 | 0/30 |
| 48 | 1.944 | 50–280 | 3.0 | 0/30 |
| 49(*) | 2.437 | 50–330 | 0.3 | 30/30 |
| 50(*) | 2.437 | 50–330 | 0.4 | 3/30 |
| 51(*) | 2.437 | 50–330 | 0.5 | 0/30 |
| 52 | 2.437 | 50–330 | 1.0 | 0/30 |
| 53 | 2.437 | 50–330 | 3.0 | 0/30 |

As shown in Table 4 and FIG. 5, the protection property against breakage significantly depends on the volume of exposed pores in the first outer layer 5 and the thickness of the second outer layer 6. As shown in FIG. 5, preferable protection property against breakage, similarly to that of Embodiment 1, permitting no breakage of the outer layers is provided by the thickness t(mm) of the second outer layer 6 of 1.3/V, where V (ml/g) is the volume of the exposed pores in the first outer layer 5 (denoted by the curve B in FIG. 5). Even when the non-ohmic interface of the voltage-non-linear resistor is broken, the first outer layer absorbs melting fragments and gaseous substances and reduces an increase of an internal pressure in the resin caused by heat. Then, the second outer having a strength more than a predetermined level traps the melting fragments and gaseous substances therein, hence preventing the varistors from breakage of the outer layers and scattering of the melting fragments. The samples accompanied by "(★)" in Table 4 did not have preferable characteristics.

The first outer layer 5 according to Embodiment 2 formed by foaming and curing the epoxy resin powder added with the heat decomposable chemical foaming agent has preferably the volume of the exposed pores ranging from 0.5 ml/g to 3.0 ml/g. The volume of the exposed pores in the first outer layer 5 smaller than 0.5 ml/g requires the thickness of the second outer layer 6 greater than 2.5 mm, or than substantially 3 mm for ensuring stability in its manufacturing process. This thickness increases the number of processes for manufacturing the second outer layer 6 and hence increase the overall production cost of the varistor as well as the overall dimensions. The volume of the exposed pores exceeding 3.0 ml/g provides the exposed pores having diameters equal to or more than 500 μm. The diameter reduces an electrical insulation between the electrodes 2 along the voltage non-linear resistor 1, hence having the electrical insulating properties of the varistor decline.

Thus, the volume of the exposed pores in the first outer layer 5 formed by foaming and curing the epoxy resin powder added with the heat decomposable chemical foaming agent preferably ranges from 0.5 ml/g to 3.0 ml/g. An encapsulated varistor having the thickness t(mm) of the second outer layer equal to or more than 1.3/V, where V(ml/g) is the volume of the exposed pores in the first outer layer 5 has preferable protection property against breakage. The varistor includes the outer layers not broken even when the non-ohmic interface of the varistor element is broken.

The encapsulated varistor of Embodiment 2 including the first outer layer 5 provided by foaming and curing the epoxy resin powder added with the heat decomposable chemical foaming agent has its insulating properties not reduced even when the volume of the exposed pores in the first outer layer 5 is larger than that of the encapsulated varistor of Embodiment 1, hence allowing the first outer layer 5 and the second outer layer 6 to be designed more flexibly.

INDUSTRIAL APPLICABILITY

An encapsulated varistor according to the present invention has a protection property against breakage that no outer layers are not broken even when a non-ohmic interface of a voltage-non-linear resistor is broken down with a voltage input thereto exceeding a rated level.

What is claimed is:

1. A varistor comprising:

a varistor element;

a first layer provided on the varistor element, the first layer being porous; and a second layer provided on the first layer, wherein a thickness t (mm) of the second layer is not smaller than 1.3/V, where V(ml/g) is a volume of pores provided in the first layer and exposed to an outside of the first layer.

2. The varistor according to claim 1, wherein the first layer is formed by foaming and curing epoxy resin powder added with thermally-expandable micro-capsules.

3. The varistor according to claim 2, wherein the volume V of the pores ranging from 0.5 ml/g to 2.0 ml/g.

4. The varistor according to claim 1, wherein the first layer is formed foaming and curing epoxy resin powder added with heat decomposable chemical foaming agent.

5. The varistor according to claim 4, wherein the volume V of the pores ranges from 0.5 ml/g to 3.0 ml/g.

6. The varistor according to claim 1, further comprising a heat sensitive material provided on the second layer, the heat sensitive material having an appearance changing according to heat received by the heat sensitive material.

* * * * *

UNITED STATES PATENT AND TRADEMARK OFFICE

CERTIFICATE OF CORRECTION

PATENT NO. : 6,943,659 B2
DATED : September 13, 2005
INVENTOR(S) : Tsutomu Kitsui et al.

It is certified that error appears in the above-identified patent and that said Letters Patent is hereby corrected as shown below:

Title page,
Item [57], ABSTRACT,
Line 2, "th" should read -- the --.
Line 4, "1.3/V." should read -- 1.3/V, --.

Signed and Sealed this

Eighteenth Day of April, 2006

JON W. DUDAS
*Director of the United States Patent and Trademark Office*